US006154622A

United States Patent [19]

Takegoshi et al.

[11] Patent Number: 6,154,622

[45] **Date of Patent: *Nov. 28, 2000**

[54] LASER BEAM PRINTER

[75] Inventors: Tetsuji Takegoshi, Hitachiohta; Kazuo Kikuchi, Hitachi; Noriyoshi Ogura, Sayama, all of Japan

[73] Assignee: Hitachi, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/145,259

[22] Filed: Sep. 2, 1998

[30] Foreign Application Priority Data

Sep. 9, 1997 [JP] Japan ..... 9-243719

[51] Int. Cl.[7] ..... G03G 15/00

[52] U.S. Cl. ..... 399/107

[58] Field of Search ..... 399/107; D18/54.55; 206/316.1; 312/223.1, 223.2

[56] References Cited

U.S. PATENT DOCUMENTS

| | | | |
|---|---|---|---|
| D. 343,194 | 1/1994 | Tashiro et al. | D18/55 |
| 5,532,792 | 7/1996 | Hattori | 399/81 |
| 5,815,775 | 9/1998 | Miyasaka et al. | 399/162 |

*Primary Examiner*—William J. Royer
*Attorney, Agent, or Firm*—Antonelli, Terry, Stout & Kraus, LLP

[57] ABSTRACT

The top surface of the exterior case of a printing apparatus is formed of a first top surface portion which lies substantially above a fixation unit and a paper ejector, a second top surface portion which lies substantially above a control unit, and a third top surface portion which lies substantially above development units, a photosensitive belt and a transfer drum. The levels of the respective top surface portions are higher in the order of the first top surface portion, the second top surface portion and the third top surface portion. Top surface portions of higher levels are located from the front of the upper surface of the exterior case toward the back.

17 Claims, 3 Drawing Sheets

LASER BEAM PRINTER

FIELD OF THE INVENTION

The present invention relates to a laser beam printer, and more particularly to a laser beam printer of the desktop type which is installed on a desk for use.

BACKGROUND OF THE INVENTION

With the rapid downsizing of information processors, the environment thereof has become one in which a network can be easily built even in a small-scale office.

In such an environment, users require printers to be small-size, high-speed color ones as output apparatuses.

Also in the field of network printers, therefore, the mainstream is small-sized network printers which are adapted to A4-size and can be installed on a desk in an office.

The size of a laser beam printer used as a prior-art network printer is determined by the size of the paper cassette, the photosensitive belt and the transfer drum because in the printing process of the printer paper sheets are printed one by one. The size of the fixation unit is determined by the cooling efficiency relative to the printing speed since the toner is thermally fixed.

Accordingly, the external dimensions of the printer are determined by the printing sheet size and the printing speed, and so designed as to be minimums.

With the prior art, the volume of the apparatus is substantially determined by the sheet size and the printing speed. In view of the reduction of the size of the apparatus, therefore, it is effective to minimize the installation area.

Since, however, the paper cassette is usually provided at the bottom part of the apparatus, the prior art has the problem that the installation area also cannot be further decreased.

SUMMARY OF THE INVENTION

An object of the present invention is to provide a laser beam printer in which visual correction for making the printer look smaller is adopted.

A feature of the present invention resides in a laser beam printer comprising an exterior case which houses therein devices for forming an image by use of a laser beam and for printing the image on a sheet of paper, and a top surface which includes at least two top surface portions of different levels, which is formed at an upper surface of the exterior case, and holds the printed sheet of paper.

Another feature of the present invention resides in a laser beam printer comprising an exterior case which houses therein devices for forming an image by use of a laser beam and for printing the image on a sheet of paper, and a top surface which includes at least two top surface portions of different levels, which is formed at the upper surface of the exterior case, and holds the printed sheet of paper, wherein the levels of the top surface portions are higher from the front of the upper surface of the exterior case toward the back.

Still another feature of the present invention resides in a laser beam printer comprising an exterior case which houses therein devices for forming an image by use of a laser beam and for printing the image on a sheet of paper, and a top surface which includes at least two top surface portions of different levels, which is formed at the upper surface of the exterior case, and which holds the printed sheet of paper, wherein the levels of the top surface portions having smaller projected areas are higher.

Yet another feature of the present invention resides in a laser beam printer comprising an exterior case which houses therein devices for forming an image by use of a laser beam and for printing the image on a sheet of paper, and a top surface which includes at least two top surface portions of different levels, which is formed at the upper surface of the exterior case, and holds the printed sheet, wherein the levels of the top surface portions are higher from the front of the upper surface toward the back, and the levels of the top surface portions having smaller projected areas are higher.

According to the present invention, the top surface of the printing apparatus is formed of a plurality of top surface portions having the different levels and the different projected areas, and the outside shape of the printing apparatus is so designed that a plurality of blocks corresponding to the respective top surface portions are put together.

The block configuration is such that the block whose top surface portion having the largest projected area among the block group lies at the lowest part of the top surface of the printing apparatus.

Besides, as the level of the top surface portion of the block is higher, the projected area of the top surface portion is smaller, and the block is disposed nearer to the back part of the printing apparatus.

Thus, the size of the largest one of the plurality of blocks is visually recognized as the external size of the printing apparatus, bringing forth the effect that the printing apparatus looks smaller than the printing apparatus configured as a single block.

DETAILED DESCRIPTION OF THE INVENTION

Now, a laser beam printer of one embodiment according to the present invention will be described with reference to the drawings.

Figure 1:
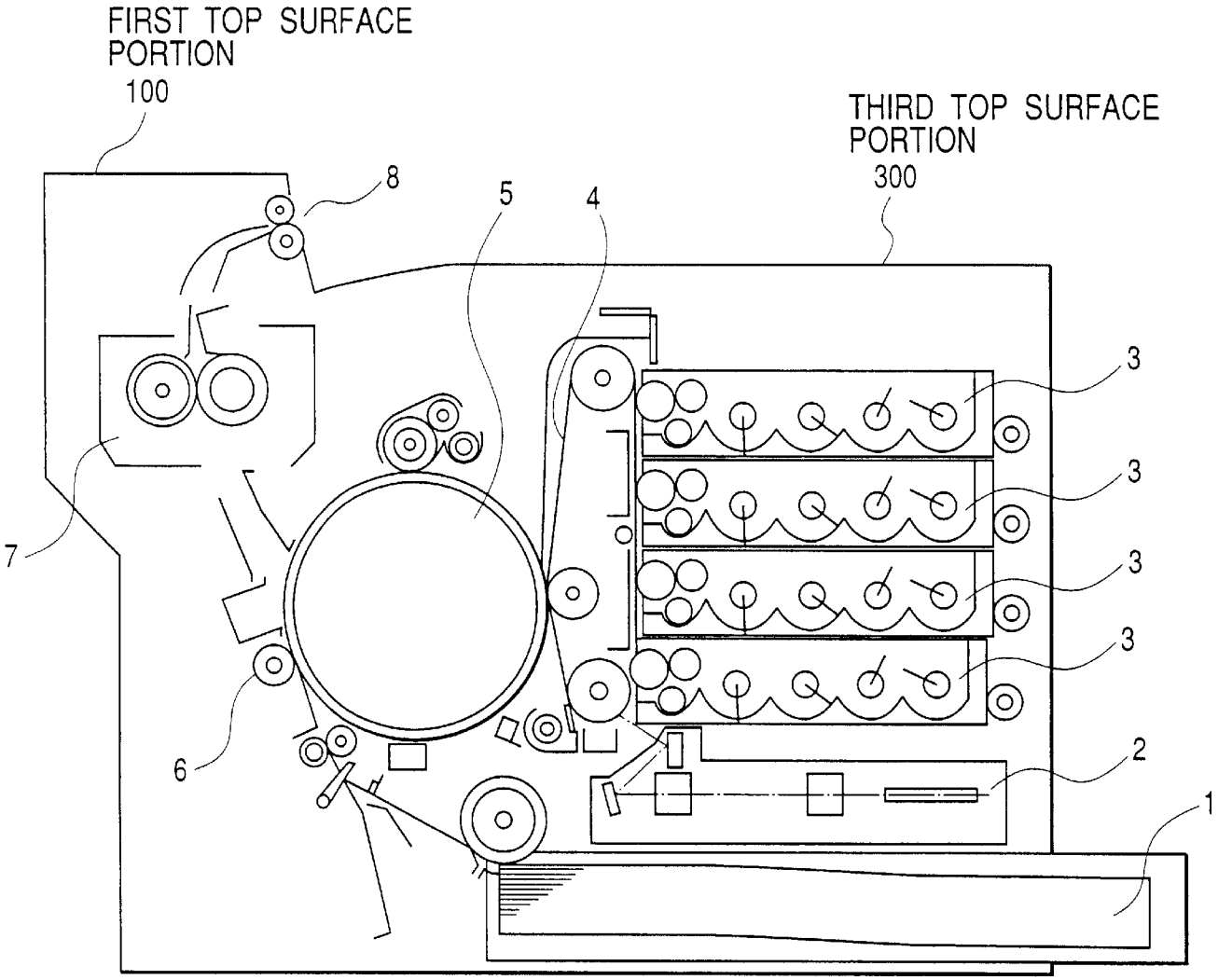
FIG. 1 is a view showing the internal essential construction of a printing apparatus of one embodiment according to the present invention.

FIG. 1 illustrates the internal essential construction of a laser beam printer of one embodiment according to the present invention, specifically the construction of a printing system which is interposed between main frames 9.

A paper cassette 1 is provided at the bottom part of the laser beam printer. Above the paper cassette 1 is provided a laser output unit 2, above which is further provided a plurality of development units 3. Behind the development units 3, a photosensitive belt 4, a transfer drum 5 and a transfer unit 6 are arranged in the order mentioned. Above transfer unit 6 is provided a fixation unit 7, above which is further provided a paper ejector 8.

The laser beam printer of this embodiment is characterized in that the sizes of the internal devices are provided with the minimum dimensions possible for effecting printing for the size of the sheet of paper to be utilized.

More specifically, generally the depth dimension of a printing apparatus is dominantly the size of the A4-size sheet cassette 1. In this embodiment the depth dimension is determined by the paper cassette 1 and the paper pickup mechanism. Since the printing apparatus is a A4-size page printer, the necessary circumferential lengths of the transfer drum 5 and the photosensitive belt 4 are determined by the longitudinal dimension of the A4 size sheet.

Accordingly, the construction of the printing apparatus having the depthwise dimension determined by the paper cassette 1 is such that the photosensitive belt 4 is vertically arranged, and it is in contact with the transfer drum 5 and the development units 3. Thus, a space-saving layout is realized.

The transfer unit 6 is located behind the transfer drum 5, and the fixation unit 7 and the paper ejector 8 are located above this transfer unit 6. The fixation unit 7 and the paper ejector 8 are laid out above the transfer drum 5.

Besides, as will be detailed later, a first top surface portion 100 is disposed above the fixation unit 7 and the paper ejector 8, while a third top surface portion 300 is disposed above the development units 3, photosensitive belt 4 and transfer drum 5.

Figure 2:
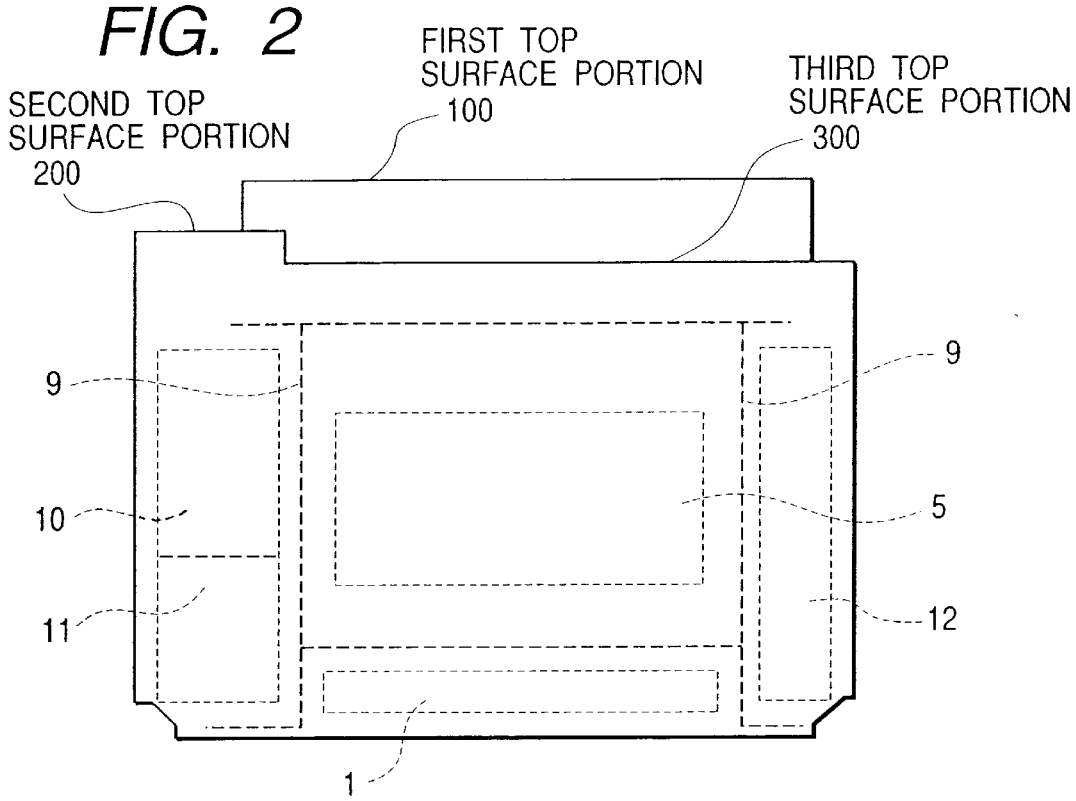
FIG. 2 is a front view showing the internal essential construction of the printing apparatus of FIG. 1.

FIG. 2 illustrates the internal essential construction of the printing apparatus shown in FIG. 1.

The printing process system including the transfer drum 5 is located inside the main frames 9, and a control unit 10, a power supply unit 11 and a drive unit 12 are located outside this printing process system.

The widthwise dimension of the printing apparatus is determined by the paper size, and the mounting relations of sensors necessary for the printing process system, the drive unit 12, etc.

Figure 3:
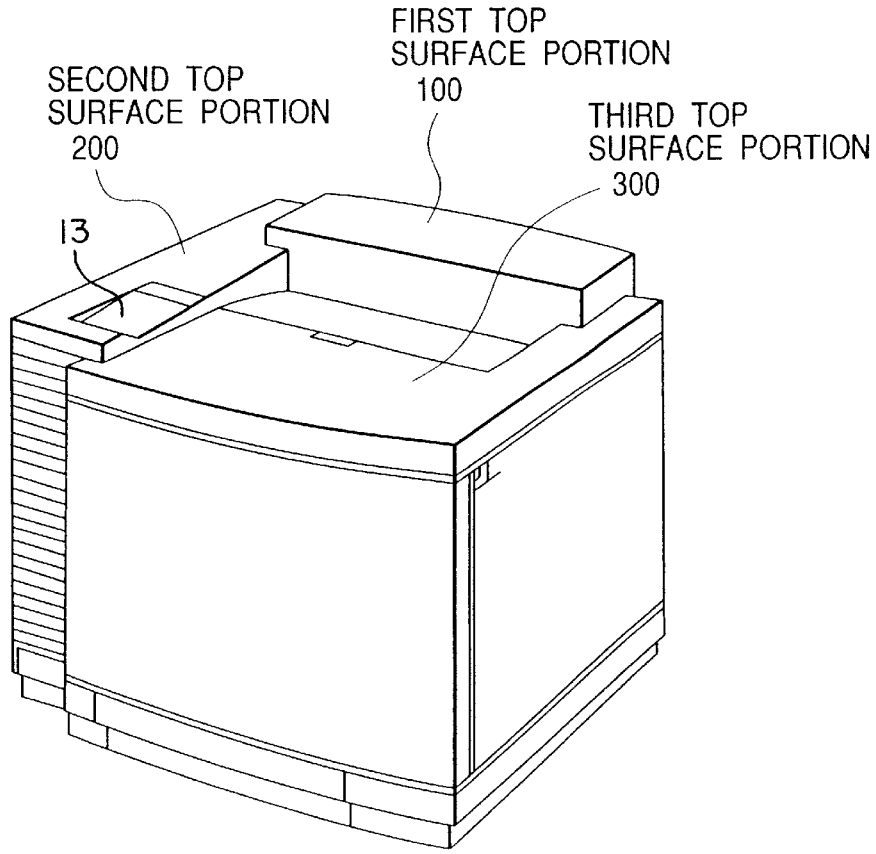
FIG. 3 is an external perspective view of the printing apparatus of FIG. 1.
Figure 4:
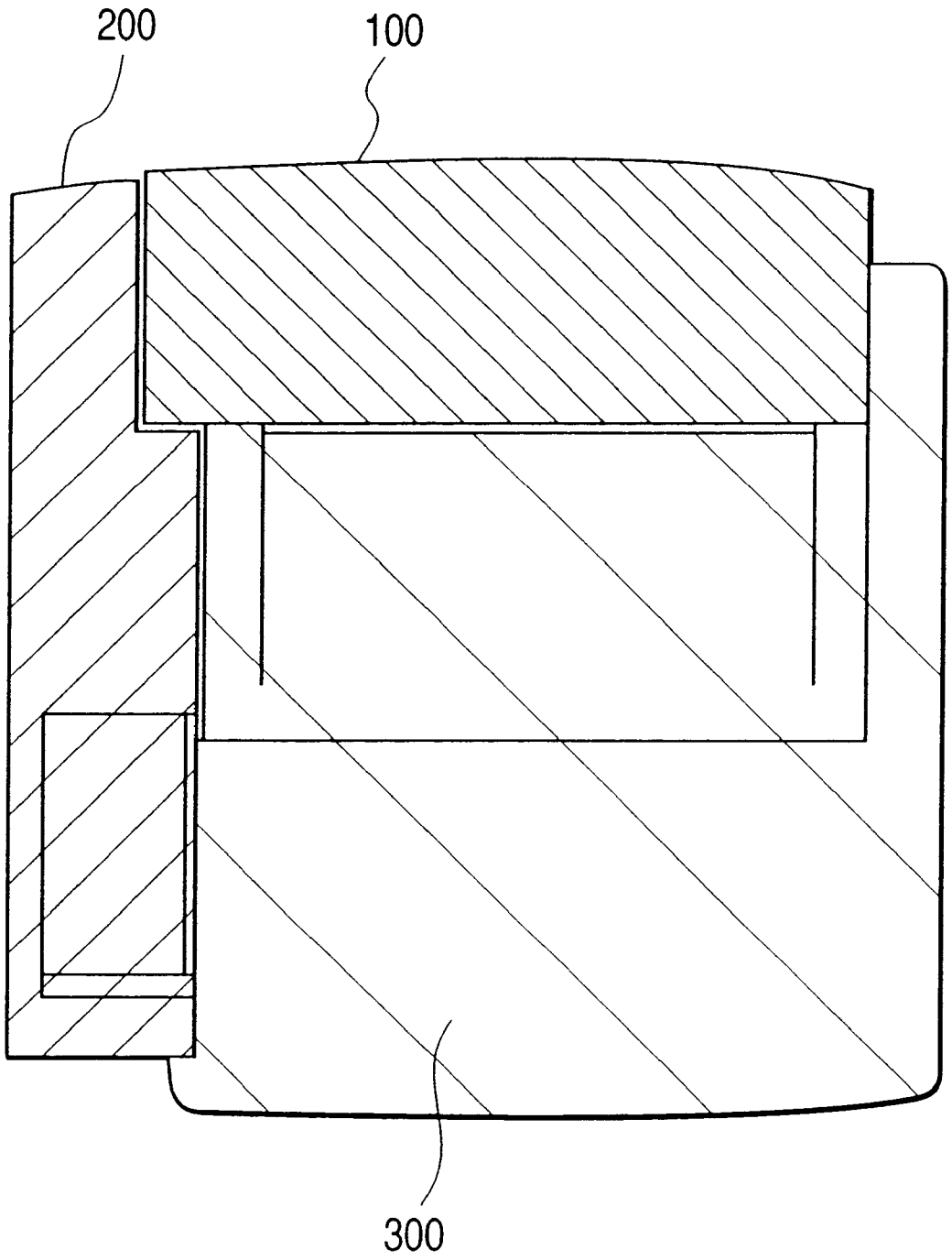
FIG. 4 is an external plan view of the printing apparatus of FIG. 1.

FIG. 3 illustrates the perspective appearance of the printing apparatus shown in FIG. 1, and FIG. 4 is a plan view illustrating the appearance of the same.

The top surface of the exterior configuration of the printing apparatus includes a first top surface portion 100, a second top surface portion 200 and a third top surface portion 300.

The surface behind a paper ejection slot, which is the first top surface portion 100, lies above the fixation unit 7 and the paper ejector 8. The attaching surface of an operating panel 13, which is the second top surface portion 200, lies above the control unit 10 which is located outside the main frames 9. The paper stacking surface which is the third top surface portion 300, lies above the development units 3, photosensitive belt 4 and transfer drum 5.

The third top surface portion 300 is disposed at the lowest level of the top surface of the printing apparatus, the second top surface portion 200 is disposed at a higher level, and the first top surface portion 100 is disposed at a still higher level.

As seen from FIG. 4 in which hatched parts show the projected areas of the respective top surface portions, the projected area of the third top surface portion 300 is the largest, that of the second top surface portion 200 is smaller, and that of the first top surface portion 100 is the smallest.

For visual correction for making the laser beam printer look smaller, this embodiment is so contrived that the top surface of the laser beam printer includes the three top surface portions which have the levels and projected areas differing from one another, and that three blocks which correspond to the respective top surface portions are put together to define the external shape of the laser beam printer.

Further, the positional relationship among the three blocks having the top surface portions is such that, as the projected area of the top surface portion of the block is smaller, the level of the top surface portion is higher.

Still further, the positional relationship in the depthwise direction of the laser beam printer among the three blocks having the top surface portions is such that the block having the smallest projected area top surface portion is located nearer to the back of the laser beam printer.

In accordance with the present invention, the top surface of a laser beam printer is formed of at least two top surface portions of different levels, whereby visual corrections of the exterior shape of the laser beam printer can be made.

Owing to the visual corrections, the size of the largest one of a plurality of blocks is recognized as the size of the external shape of the laser beam printer. There is a tendency that only the largest block imparts a strong visual impression, and that the other smaller blocks are neglected.

Consequently, the laser beam printer according to the present invention looks smaller than in cases where the whole laser beam printer is structured in a single block, and a sensory room is felt in the space where the laser beam printer is installed, bringing forth the effect to give a spacious environment of life.

What is claimed is:

1. A laser beam printer comprising an exterior case which houses therein a plurality of devices for forming an image by use of a laser beam and for printing the image on a sheet of paper, the plurality of devices including a transfer unit having an axis, a drive unit provided on one side of the transfer unit in the direction of the axis of the transfer unit, and a control unit which controls at least one of the plurality of devices and provided on an other side of the transfer unit in the direction of the axis of the transfer unit, a top surface being formed at an upper surface of the exterior case and holding at least one printed sheet thereon, the top surface having at least two top surface portions including a first top surface portion and a second top surface portion having different height levels from one another, the first top surface portion having a first height level and being located so as to lie substantially above and extend over the drive unit, and the second top surface portion having a second height level which is higher than the first height level and being located so as to lie substantially above and extend over the control unit.

2. A laser beam printer according to claim 1, wherein the exterior case includes a front portion and a rear portion and the different height levels of the at least two top surface portions are arranged so that a highest height level is provided proximate to the rear portion and a lowest height level is provided proximate to the front portion.

3. A laser beam printer according to claim 1, wherein the at least two top surface portions having different height levels have projected areas of a size which is a function of a height level thereof so that the highest height level has a smallest size of projected area and the lowest height level has a largest size of projected area.

4. A laser beam printer according to claim 1, wherein the exterior case includes a front portion and a rear portion and the different height levels of the at least two top surface portions are arranged so that a highest height level is provided proximate to the rear portion and a lowest height level is provided proximate to the front portion, and wherein the at least two top surface portions having different height levels have projected areas of a size which is a function of the height level thereof so that the highest height level has the smallest size of projected area and the lowest height level has a largest size of projected area.

5. A laser beam printer according to claim 1, wherein an exterior surface includes a front portion and a rear portion and three top surface portions having different height levels are provided, a third top surface portion having a third height level which is higher than the second height level of the second top surface portion, the third top surface portion being located proximate to the rear portion, the first top surface portion being located proximate to the front portion and extending in front of the third top surface portion, and the second top surface portion being arranged proximate to one side of the first top surface portion.

6. A laser beam printer according to claim 5, wherein the three top surface portions having different height levels have projected areas of a size which is a function of the height level thereof so that the third top surface portion having a highest height level has a smallest size of projected area, the first top surface portion having a lowest height level has a largest size of projected area and the second top surface portion having an intermediate height level has an intermediate size of projected area.

7. A laser beam printer according to claim 6, wherein each of the first, second and third top surface portions have major portions thereof extending substantially in respective horizontal planes, the axis of the transfer unit extending substantially in a horizontal direction between and substantially in parallel to the front and rear portions.

8. A laser beam printer having a top surface which is formed at an upper surface of an exterior case and which serves to hold printed sheets of papers, the exterior case housing therein a plurality of devices including a photosensitive belt on which an electrostatic latent image is formed by use of a laser beam, a development unit which develops the electrostatic latent image, a transfer drum having an axis and a transfer unit which transfers the developed image onto a sheet of paper, a fixation unit which fixes the image transferred onto the sheet of paper, a paper ejector which ejects the sheet of paper, a drive unit provided on one side of the transfer drum in the direction of the axis of the transfer drum, and a control unit which controls at least one of the plurality of devices and which is provided on an other side of the transfer drum in the direction of the axis of the transfer drum, the top surface including a first top surface portion which lies substantially above and extends over the fixation unit and the paper ejector, a second top surface portion which lies substantially above and extends over the control unit, and a third top surface portion which lies substantially above and extends over the development unit, the photosensitive belt, the transfer drum and the drive unit, the first, second and third top surface portions having different height levels which differ from one another with the first and second top surface portions having height levels which are higher than the height level of the third top surface portion.

9. A laser beam printer according to claim 8, wherein the first top surface portion has a height level which is higher than the height level of the second top surface portion.

10. A laser beam printer according to claim 8, wherein an operating panel for operating at least one of the plurality of devices is disposed in the second top surface portion.

11. A laser beam printer according to claim 8, wherein the exterior case includes a front portion and a rear portion, the third top surface portion being located proximate to the front portion, the first top surface portion being located proximate to the rear portion and the second top surface portion being located at one side of the first and third top surface portions.

12. A laser beam printer according to claim 8, wherein the first, second and third top surface portions have projected areas of a size which is a function of the height levels thereof so that the first top surface portion which has a highest height level has a smallest size of projected area, the third top surface portion which has a smallest height level has a largest size of projected area and the second top surface portion which has an intermediate height level has an intermediate size of projected area.

13. A laser beam printer according to claim 8, wherein the exterior case includes a front portion and a rear portion, the third top surface portion being located proximate to the front portion, the first top surface portion being located proximate to the rear portion and the second top surface portion being located at one side of the first and third top surface portions, and wherein the first, second and third top surface portions have projected areas of a size which is a function of the height levels thereof so that the first top surface portion which has a highest height level has a smallest size of projected area, the third top surface portion which has a lowest height level has a largest size of projected area and the second top surface portion which has an intermediate height level has an intermediate size of projected area.

14. A laser beam printer according to claim 13, wherein an operating panel for operating at least one of the plurality of devices is disposed in the second top surface portion.

15. A laser beam printer according to claim 14, wherein each of the first, second and third top surface portions have major portions thereof extending substantially in respective horizontal planes, the axis of the transfer drum extending substantially in a horizontal direction between and substantially in parallel to the front and rear portions.

16. A laser beam printer according to claim 8, wherein a paper exit portion is lower than the third top surface portion, and the first top surface portion is located at the opposite side of the paper exit portion from the third top surface portion.

17. A laser beam printer according to claim 8, wherein a paper exit portion is lower than the third top surface portion, and a portion extended from the third top surface portion is located at the opposite side of the paper exit portion from the second top surface portion.

* * * * *